US007159907B2

(12) United States Patent
Song

(10) Patent No.: US 7,159,907 B2
(45) Date of Patent: Jan. 9, 2007

(54) JAM-RESISTANT DOOR LATCH ASSEMBLY FOR VEHICLES

(75) Inventor: Jai Bong Song, Siheung-si (KR)

(73) Assignee: Kia Motors Corporation, Seoul (KR)

( * ) Notice: Subject to any disclaimer, the term of this patent is extended or adjusted under 35 U.S.C. 154(b) by 192 days.

(21) Appl. No.: 11/025,890

(22) Filed: Dec. 28, 2004

(65) Prior Publication Data

US 2006/0006670 A1 Jan. 12, 2006

(30) Foreign Application Priority Data

Jun. 21, 2004 (KR) ..... 10-2004-0046204

(51) Int. Cl.
*E05C 3/06* (2006.01)

(52) U.S. Cl. ..... 292/216; 292/DIG. 23

(58) Field of Classification Search ..... 292/216, 292/201, DIG. 23

See application file for complete search history.

(56) References Cited

U.S. PATENT DOCUMENTS 6,540,272 B1 * 4/2003 Spurr ..... 292/216
6,913,298 B1 * 7/2005 Inoue ..... 292/216

* cited by examiner

*Primary Examiner*—Gary Estremsky
(74) *Attorney, Agent, or Firm*—Morgan Lewis & Bockius LLP

(57) ABSTRACT

Disclosed herein is a jam resistant door latch assembly which is provided, between a central portion of an outside lever and a lock lever, with a jam-releasing lever of a linkage structure that serves to resiliently pull the outside lever to a normal unlocked position of the door latch assembly to allow a jammed outside lever to be easily released, so that when a driver or passenger only pulls a door handle toward himself or herself to its original position after simultaneously pulling a second rod member and a lock lever, the outside lever is moved to a normal unlatched position of the door latch assembly to actuate the release lever to open the door, thereby improving the convenience in using the vehicle's door and improving the vehicle's quality and reliability.

7 Claims, 6 Drawing Sheets

JAM-RESISTANT DOOR LATCH ASSEMBLY FOR VEHICLES

CROSS REFERENCE TO RELATED APPLICATION

This application claims priority from Korean Patent Application No. 2004-0046204, filed on Jun. 21, 2004, which is hereby incorporated by reference in its entirety.

FIELD OF THE INVENTION

The present invention relates to a jam resistant door latch assembly for vehicles. More particularly, the present invention relates to a jam resistant door latch assembly for vehicles that is between the central portion of an outside lever and a lock lever with a jam-releasing lever of a linkage structure that serves to resiliently pull the outside lever to a normal unlocked position to allow a jammed outside lever to be easily released, thereby preventing a jam from occurring between the outside lever and a release lever when the door handle is actuated in advance of the unlatching of the door latch assembly so as to open a vehicle door.

BACKGROUND OF THE INVENTION

In general, a vehicle door enables the driver or passenger to get on or off a vehicle and includes a door hinge, a door lock, a door checker, a window regulator and the like. Among these working components, the door lock functions to lock the vehicle door by engaging a door latch and a striker. The driver or passenger employs a vehicle key, a remotely controlled actuator (i.e., a remote control), a locking door handle or the like in order to latch or unlatch a door latch assembly, so that the door is not opened easily even though the door handle, i.e., an inside door or outside door handle, is actuated from the inside or outside of the vehicle.

However, the conventional door latch assembly has the following problem. In the case when the latched door latch assembly is released using a car key or a remote control and when an outside or inside door handle is pulled toward an operator in advance of the manual actuation of the car key or remote control to open the door, or is actuated in advance prior to the completion of the unlatching of the door latch assembly, a so-called "jam" may occur.

Of course, when the jam occurs, in order to unlock and open the door, the driver or passenger must re-unlatch the door latch assembly using a car key or a remote control by pulling the outside door handle pulled toward himself or herself go to its original position, and then pull the door outside handle toward himself or herself.

However, frequent occurrence of this type of jam may result in a degradation in the vehicle's quality and reliability. In addition, a user is inconvenienced by repeatedly manipulating the door latch assembly such as latching and unlatching of the door latch assembly.

There is, therefore, a need for an improved approach to these deficiencies.

SUMMARY OF THE INVENTION

Accordingly, the present invention has been made to solve the above problems occurring in the prior art, and it is an object of the present invention to provide a jam resistant door latch assembly for vehicles, which is provided between the central portion of an outside lever and a lock lever with a jam-releasing lever of a linkage structure that serves to resiliently pull the outside lever to a normal unlocked position of the door latch assembly to allow a jammed outside lever to be easily released. In other words, when the driver or passenger only pulls the door handle toward himself or herself to its original position after simultaneously pulling a second rod member and a lock lever, the outside lever moves to a normal unlatched position of the door latch assembly to actuate the release lever to open the door, thereby improving the convenience in using the vehicle's door and improving the vehicle's quality and reliability.

To accomplish the above object, the present invention provides a jam-resistant door latch assembly for vehicles, which includes an outside lever adapted to move up or down in response to the actuation of an outside or inside door handle; a release lever operating in cooperation with the outside lever in such a manner as to rotate in a clockwise or counterclockwise direction in response to the upward or downward movement of the outside lever so as to allow the engagement or disengagement of the door latch assembly against or from a striker fixed to a vehicle body to be selectively performed upon the clockwise or counterclockwise rotation thereof; a lock lever adapted to cause the outside lever to push rightward while not rotating the release lever in a counterclockwise direction in response to the actuation of the outside door handle or the inside door handle upon the clockwise directional rotation thereof so as to allow the door latch assembly to move to a latched position and to push the outside lever leftward while rotating the release lever in a counterclockwise direction in response to the actuation of the outside door handle or the inside door handle upon the counterclockwise directional rotation thereof so as to allow the door latch assembly to move to an unlatched position; and a jam-releasing lever of a linkage structure pivotally mounted between a central portion of the outside lever and the lock lever, and adapted to resiliently pull the outside lever upon the switching of the lock lever to an unlatched position of the door latch assembly, whereby a pressing end of the outside lever escapes from overlapping with the release lever in response to the actuation of the outside door handle or the inside door handle after the occurrence of a jam phenomenon between the outside lever and the release lever, and simultaneously the jam-releasing lever pivots resiliently while pulling the outside lever leftward, at which time when the driver or passenger re-actuates the door outside or inside handle, the outside lever is moved to actuate the release lever to a normal unlatched position of the door latch assembly to thereby open the door.

Preferably, the jam-releasing lever may have a torsion spring installed at its upper end which is connected to the outside lever so that the outside lever is returned to an original unlatched position of the door latch assembly, and a guide slot located along the entire length thereof for inserting a retaining protrusion of the lock lever thereto so that the retaining protrusion freely slides up and down along the guide slot by virtue of the upward and downward movement of the outside lever or the pivotal movement of the lock lever.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1A:
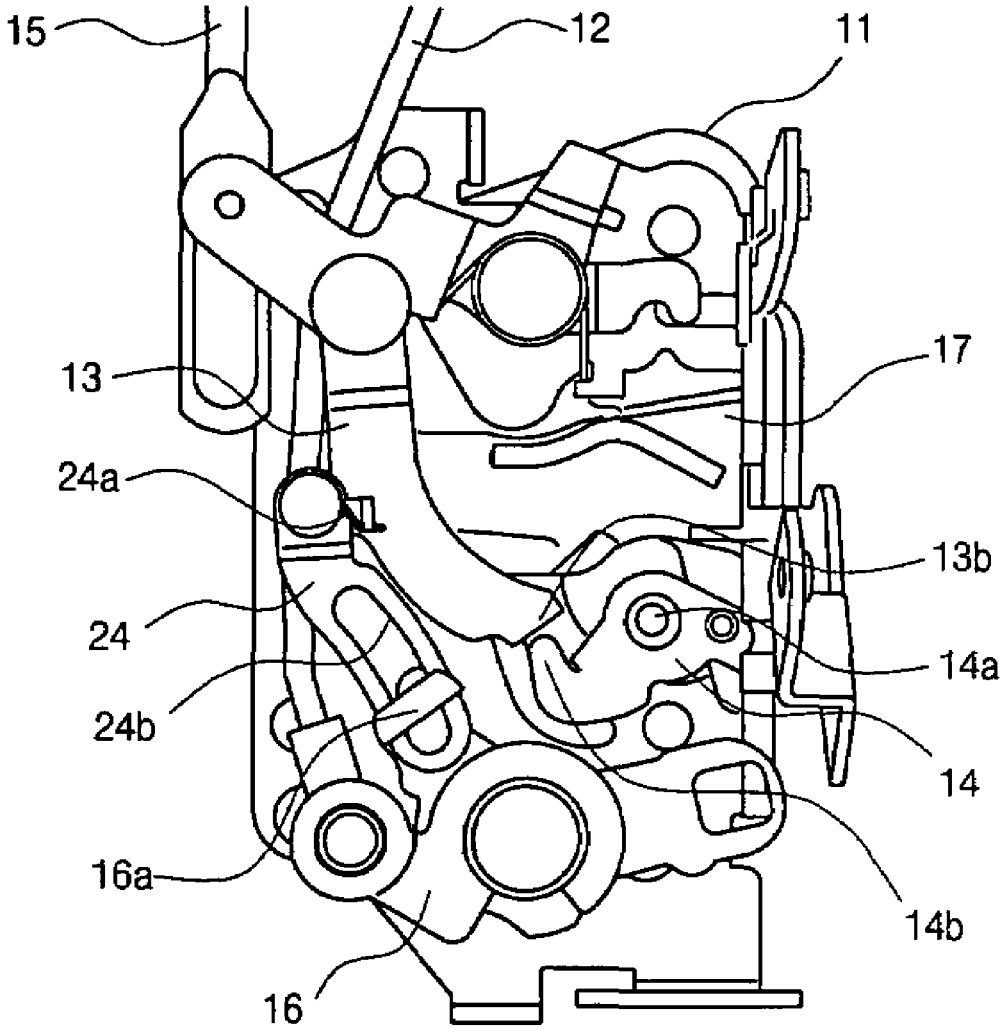
FIGS. 1*a* and 1*b* are perspective views illustrating the inner construction of a jam resistant door latch assembly for vehicles in accordance with the present invention.
Figure 1B:
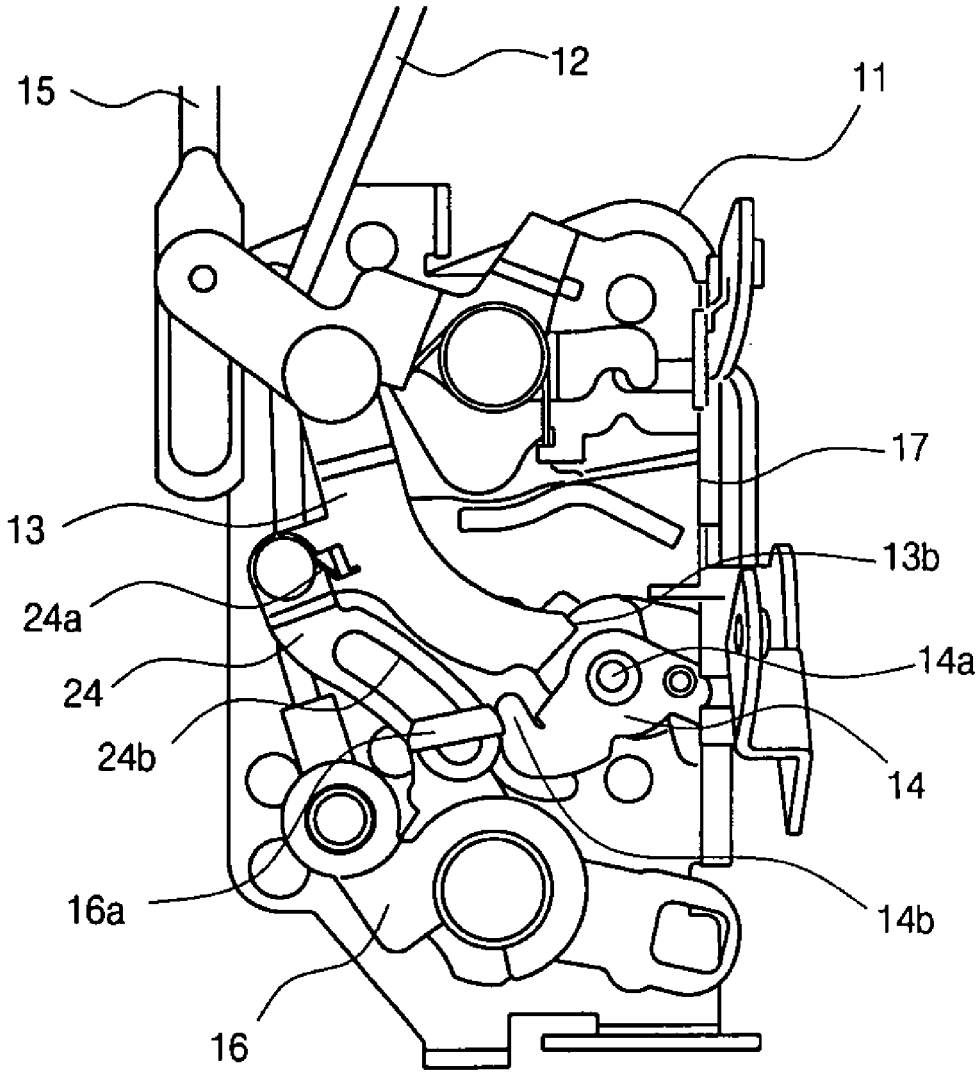
Figure 2:
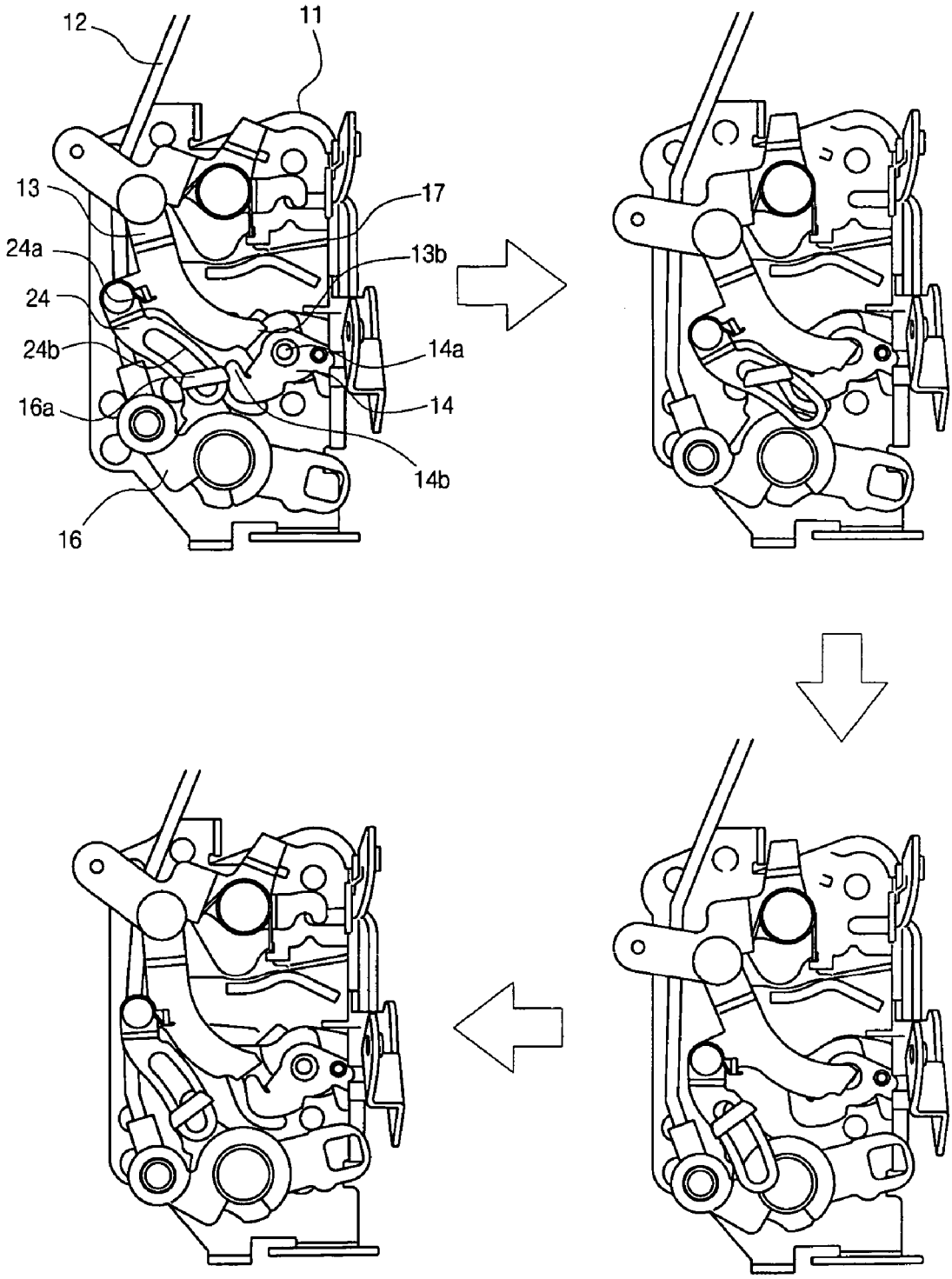
FIG. 2 provides perspective views illustrating a jam-resistant door latch assembly for vehicles which is being operated in accordance with the present invention.
Figure 3A:
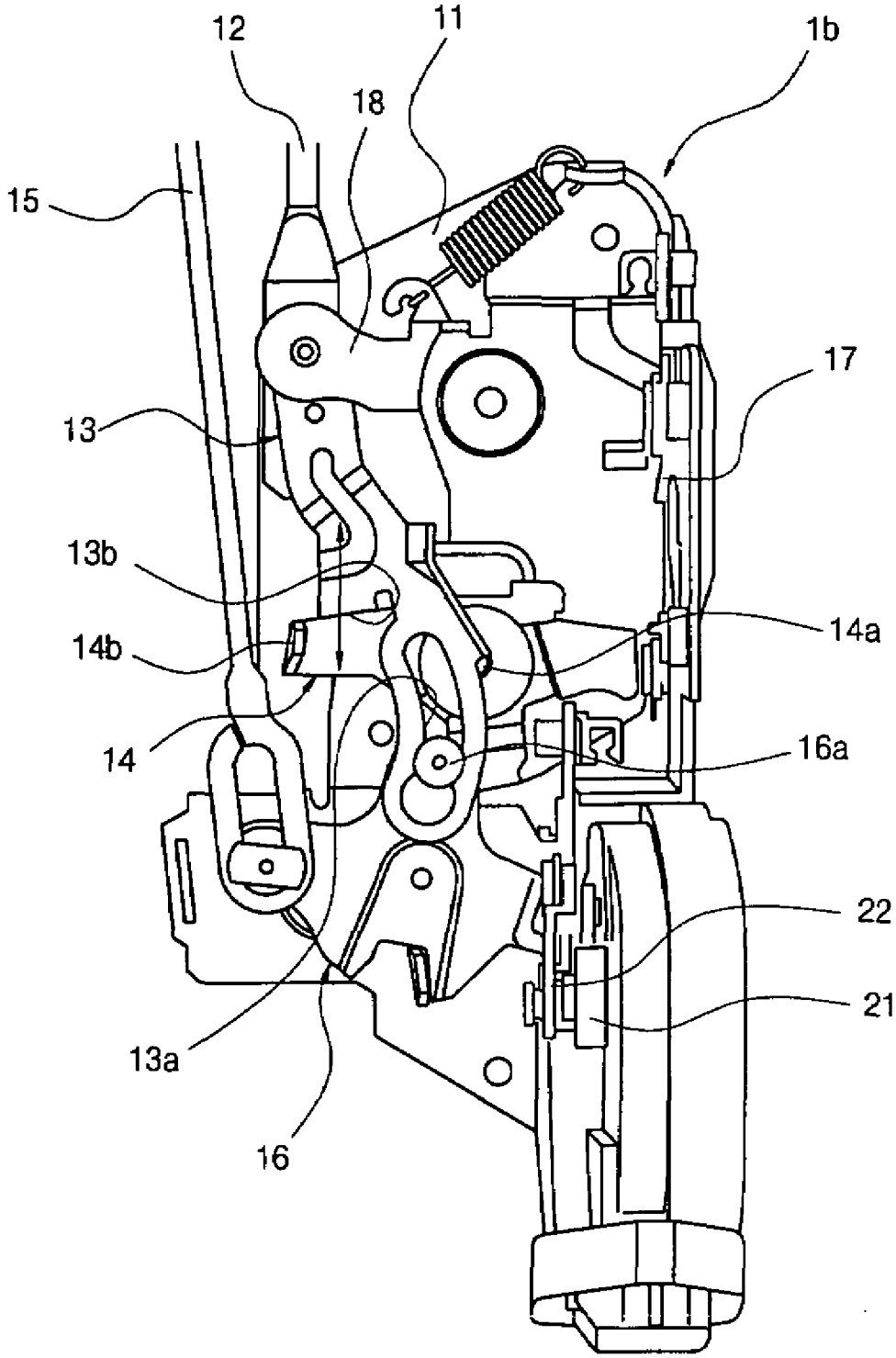
FIGS. 3*a* and 3*b* are perspective views illustrating the inner construction of a conventional door latch assembly for vehicles in accordance with the prior art.
Figure 3B:
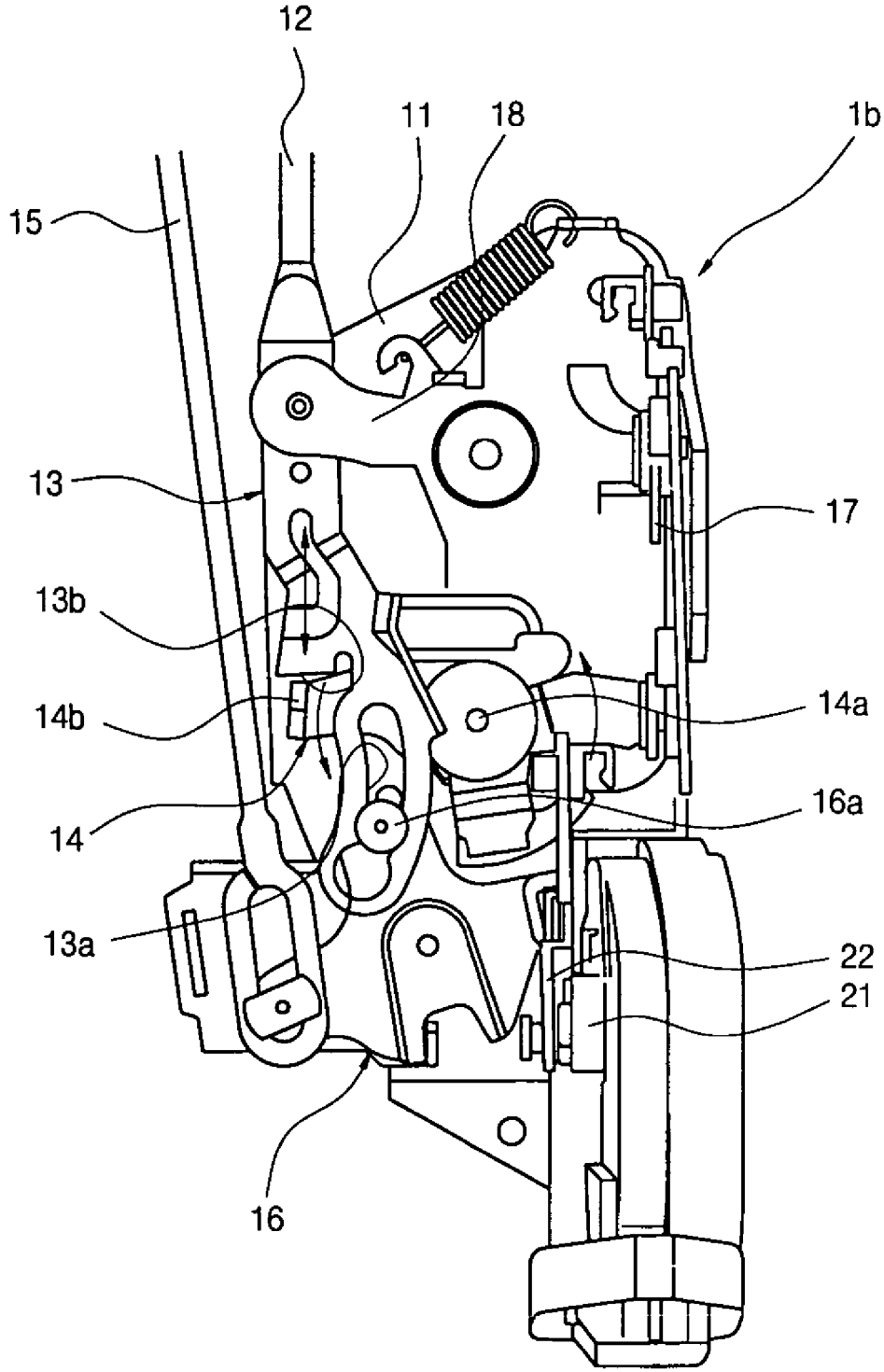
Figure 4:
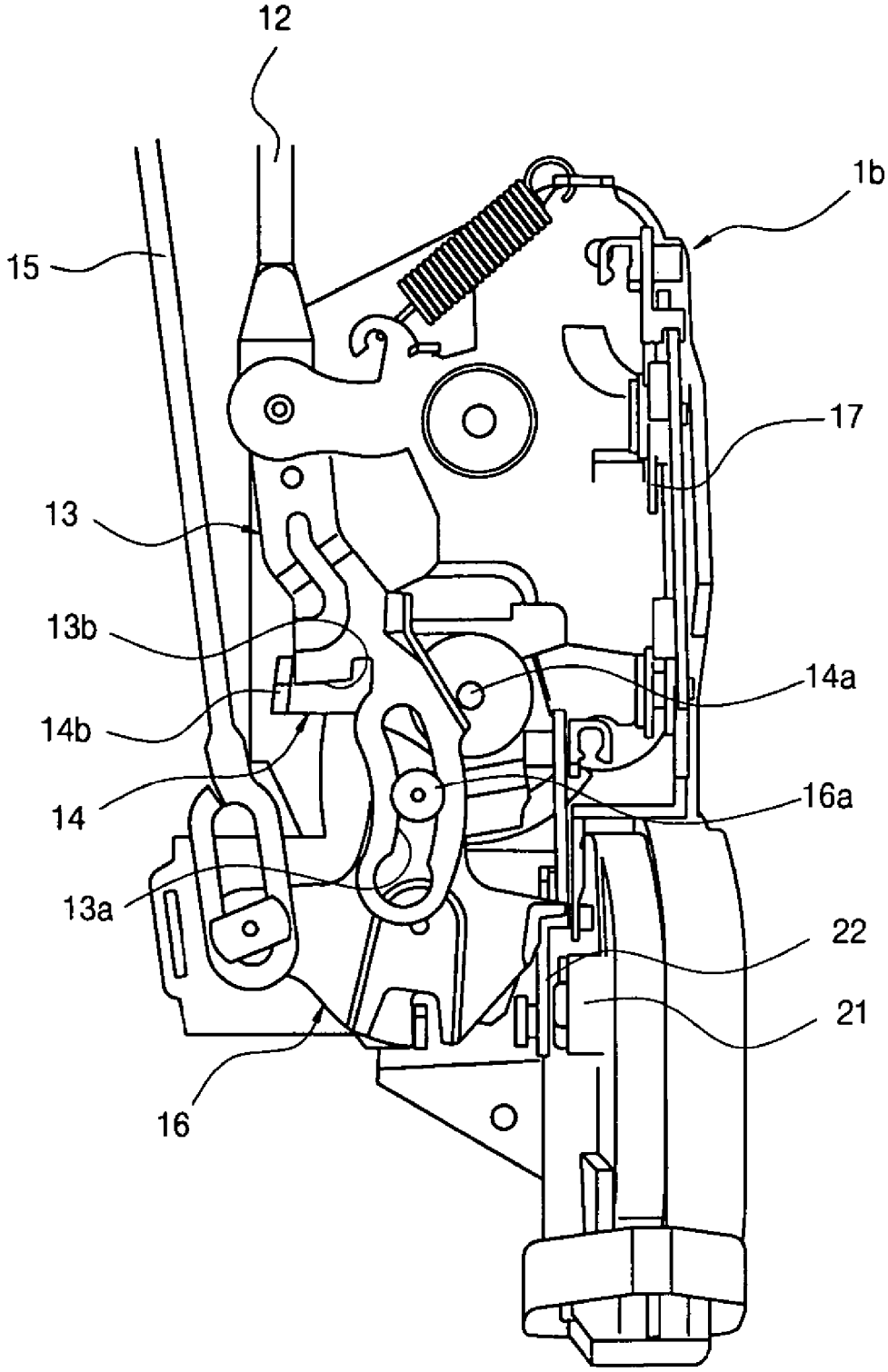
FIG. 4 is a perspective view illustrating a conventional door latch assembly for vehicles when a jam occurs, in accordance with the prior art.

FIGS. 1*a* and 1*b* are perspective views illustrating the inner construction of a jam-resistant door latch assembly for vehicles in accordance with the present invention, wherein FIG. 1*a* is a perspective view of the jam resistant door latch assembly in a latched position, and FIG. 1*b* is a perspective view of the jam resistant door latch assembly in an unlatched position.

Herein, reference numeral 11 denotes a casing of the jam-resistant door latch assembly, reference numeral 13 an outside lever, and reference numeral 14 a release lever. Also, reference numeral 16 indicates a lock lever, reference numeral 12 a first rod member coupled to the outside lever 13 for actuating the outside lever 13 in response to the actuation of an outside door handle, and reference numeral 15 a second rod member coupled to the lock lever 16 for actuating the lock lever 16.

First, the jam resistant the door latch assembly 1*a* of the present invention includes a jam-releasing lever 24 of a linkage structure mounted between the central portion of an outside lever 13 and a lock lever 16, for resiliently pulling the outside lever 13 to a normal unlocked position.

The jam-releasing lever 24 has a torsion spring installed at its upper end, which is connected to the outside lever 13; so that when a certain amount of force is exerted to the jam-releasing lever 24, the outside lever 13 is returned to its original unlatched position. Here, the resilient restoring force of the torsion spring is exerted such that the jam-releasing lever 24 pivots in a clockwise direction with respect to the drawing to push the outside lever 13 to the left. Accordingly, the outside lever 13 is returned to its original unlatched position.

In addition, a retaining protrusion 16*a* of the lock lever 16 is inserted into a guide slot 24*b* in the jam-releasing lever 24, which is along the entire length of the jam-releasing lever 24, so that it can freely slide up and down along the guide slot by virtue of the upward and downward movement of the outside lever 13 or the pivotal movement of the lock lever 16.

Consequently, in the case where a jam occurs by outwardly pulling on an outside door handle of a locked vehicle door and a driver rotates the lock lever 16 in a counterclockwise direction through a second rod member 5 to an unlatched door latch assembly 1*a*, the outside lever 13 is moved to its original position by virtue of the torsion spring 24*a*, i.e., a resilient means connected to the upper end of the jam-releasing lever 24 to actuate the release lever 14.

The operation of the present invention will now be described in more detail. First, when a driver actuates a car key or a remote control to unlatch the door latch assembly 1*a* and simultaneously pulls the outside or inside door handle before the door latch assembly 1*a* is completely released, i.e., the lock lever 16 does not completely rotate in a counterclockwise direction, the outside lever 13 that pushes down the first rod member 12 does not completely move left to a left projecting piece 14*b* of the release lever 14 and at the same time is jammed in the release lever 14. As a result, the outside lever 13 overlaps with the release lever 14 so that the vehicle door is not opened.

As described above, when a jam occurs between the outside lever 13 and the release lever 14, i.e., when the outside lever 13 was actuated, it is possible to move the lock lever 16 to an unlocked condition of the door where the lock lever can be pivoted. Since the retaining protrusion 16*a* of the lock lever 16 freely moves up and down along the guide slot 24*b* of the jam-releasing lever 24, the lock lever 16 can be moved to the unlocked position of the door.

When the lock lever 16 rotates in a counterclockwise direction to the unlatched position of the door latch assembly, the retaining protrusion 16*a* of the lock lever 16 slides up and down along the guide slot 24*b* of the jam-releasing lever 24 while rotating the jam-releasing lever 24 in a clockwise direction.

Accordingly, when the jam occurs between the outside lever 13 and the release lever 14 and when the driver pulls the outside or inside door handle toward him or her to its original position, the first rod member 12 pulls up the outside lever 13. Thereafter, the torsion spring 24*a* installed at the upper end of the jam-releasing lever 24 causes the outside lever 13 to move to a normal unlatched position of the door latch assembly as shown in FIG. 1*b*.

Afterward, when the driver or passenger re-pulls the outside or inside door handle outwardly, first rod member 12 pushes down the outside lever 13 so that the pressing end 13*b* of the outside lever 13 also pushes down the left projecting piece 14*b* of the release lever 14 to rotate the release lever 14 in a counterclockwise direction. As a result, the door latch assembly 1*a* is disengaged from the striker on the vehicle body, to thereby unlock and open the vehicle door.

As such, in the door latch assembly 1*a* of the present invention, although the jam occurs temporarily between the outside lever 13 and the release lever 14 as described above only when the driver or passenger pulls the outside or inside door handle toward him or her to its original position and then re-pulls it, the outside lever 13 moves to a normal unlatched position of the door latch assembly 1*a* to actuate the release lever 14 to thereby open the door.

When the driver or passenger actuates the vehicle door to a latched position of the door latch assembly 1*a* using a car key, the second rod member 15 causes the lock lever 16 to rotate in a clockwise direction with respect to the drawing and then the outside lever 13 is pushed right similar to the conventional door latch assembly. Accordingly, although the outside door handle is repeatedly actuated from outside of the door, the outside lever 13 that operates cooperatively with the first rod member 12 only ascends and descends with the left projecting piece 14*b* of the release lever 14, but does not push down the projecting piece 14*b* of the release lever 14. As a consequence, the door is not unlocked and opened.

As described above, according to the jam resistant door latch assembly of the present invention, between the central portion of an outside lever and a lock lever, a jam-releasing lever of a linkage structure is installed that serves to resiliently pull the outside lever to a normal unlocked position of the door latch assembly to allow a jammed outside lever to be easily released. In other words, when the driver or passenger only pulls a door handle toward himself or herself to its original position after simultaneously pulling a second rod member and a lock lever, the outside lever moves to a normal unlatched position of the door latch assembly to actuate the release lever to open the door, thereby improving the convenience in using the vehicle's door and improving the vehicle's quality and reliability.

While the foregoing description represent various embodiments of the present invention, it will be appreciated that the foregoing description should not be deemed limiting since additions, variations, modifications and substitutions may be made without departing from the spirit and scope of the present invention. It will be clear to one of skill in the art that the present invention may be embodied in other forms, structures, arrangements, and proportions and may use other elements, materials and components. The present disclosed embodiments are, therefore, to be considered in all respects as illustrative and not restrictive, the scope of the invention being indicated by the appended claims and not limited to the foregoing description.

What is claimed is:

1. A jam-resistant door latch assembly for vehicles, comprising:

an outside lever adapted to move up or down in response to the actuation of an outside door handle or an inside door handle; a release lever operating in cooperation with the outside lever in such a manner as to rotate in a clockwise direction or a counterclockwise direction in response to the upward or downward movement of the outside lever so as to allow the engagement or disengagement of a door latch assembly against or from a striker fixed to a vehicle body to be selectively performed upon the clockwise or counterclockwise rotation of the outside lever;

a lock lever adapted to push the outside lever rightward while not rotating the release lever in a counterclockwise direction in response to the actuation of the outside door handle or the inside door handle upon the clockwise directional rotation so as to allow the door latch assembly to move to a latched position and to push the outside lever leftward while rotating the release lever in a counterclockwise direction in response to the actuation of the outside door handle or the inside door handle upon the counterclockwise directional rotation thereof so as to allow the door latch assembly to be moved to an unlatched position; and a jam-releasing lever of a linkage structure pivotally mounted between a central portion of the outside lever and the lock lever, and adapted to resiliently pull the outside lever upon the switching of the lock lever to an unlatched position of the door latch assembly, whereby a pressing end of the outside lever escapes from overlapping with the release lever in response to the actuation of the outside door handle or the inside door handle after a jam occurs between the outside lever and the release lever, and simultaneously the jam-releasing lever pivots resiliently while pulling the outside lever leftward, at which time when a driver or passenger re-actuates the outside door handle or the inside door handle, the outside lever is moved to actuate the release lever to a normal unlatched position of the door latch assembly to thereby open the door.

2. The jam resistant door latch assembly according to claim 1, wherein the jam-releasing lever has a torsion spring installed at an upper end which is connected to the outside lever so that the outside lever is returned to an original unlatched position of the door latch assembly, and a guide slot located along an entire length thereof for inserting a retaining protrusion of the lock lever thereto so that the retaining protrusion freely slides up and down along the guide slot by virtue of the up and down movement of the outside lever or the pivotal movement of the lock lever.

3. A jam-resistant door assembly for vehicles, comprising:

an outside lever configured to move up and down in response to actuation of an outside door handle or an inside door handle;

a release lever, cooperating with the outside lever, the release lever rotatable in response to the up or down movement of the outside lever such that a door latch assembly engages a striker;

a lock lever configured to push the outside lever, while not rotating the release lever, in response to actuation of the outside door handle or the inside door handle so as to allow the door latch assembly to move to a latched position, the lock lever configured to push the outside lever, while rotating the release lever, in response to actuation of the outside door handle or the inside door handle so as to allow the door latch assembly to be moved to an unlatched position; and a jam-releasing lever pivotally mounted between a central portion of the outside lever and the lock lever, the jam-releasing lever being adapted to resiliently pull the outside lever upon the switching of the lock lever to an unlatched position;

whereby a pressing end of the outside lever escapes from overlapping with the release lever in response to the actuation of the outside door handle or the inside door handle after a jam occurs between the outside lever and the release lever and, substantially simultaneously the jam-releasing lever pivots resiliently while pulling the outside lever to actuate the release lever to an unlatched position.

4. The jam resistant door assembly of claim 3, wherein the jam-releasing lever has a torsion spring installed near an upper end, the spring being coupled to the outside lever such that the outside lever is returned to an unlatched position.

5. The jam resistant door assembly of claim 3, wherein the jam-releasing lever further comprises a guide slot located along a length thereof for inserting a retaining protrusion of the lock lever thereto such that the retaining protrusion slides along the guide slot by virtue of the up and down movement of the outside lever or the pivotal movement of the lock lever.

6. A jam-resistant door assembly for vehicles, comprising:

an outside lever configured to move up and down in response to actuation of an outside door handle or an inside door handle;

a release lever, cooperating with the outside lever, the release lever rotatable in response to the up or down movement of the outside lever such that a door latch assembly engages a striker;

a lock lever configured to push the outside lever while not rotating the release lever such that the door latch assembly is moved to a latched position, and the lock lever configured to push the outside lever while rotating the release lever such that the door latch assembly is moved to an unlatched position; and a jam-releasing lever pivotally mounted between a central portion of the outside lever and the lock lever;

whereby a pressing end of the outside lever escapes from overlapping with the release lever in response to the actuation of the outside door handle or the inside door handle after a jam occurs between the outside lever and the release lever.

7. The jam resistant door assembly of claim 6, wherein the jam-releasing lever further comprises a spring configured to resiliently pull the outside lever upon the switching of the lock lever to an unlatched position.

* * * * *